US005290671A

United States Patent [19]

Thomas et al.

[11] Patent Number: 5,290,671

[45] Date of Patent: Mar. 1, 1994

[54] COLOR PHOTOGRAPHIC ELEMENT PROVIDING IMPROVED DYE STABILITY

[75] Inventors: Brian Thomas, Pittsford; David J. Lacz, Honeoye Falls; William A. Mruk; Todd R. Skochdopole, both of Rochester, all of N.Y.

[73] Assignee: Eastman Kodak Company, Rochester, N.Y.

[21] Appl. No.: 887,532

[22] Filed: May 22, 1992

[51] Int. Cl.[5] ..... G03C 1/815

[52] U.S. Cl. ..... 430/512; 430/536; 430/538; 430/551; 430/961

[58] Field of Search ..... 430/537, 538, 531, 536, 430/558, 961, 512, 536, 551

[56] References Cited

U.S. PATENT DOCUMENTS

| | | | |
|---|---|---|---|
| 4,283,486 | 8/1981 | Aono et al. | 430/538 |
| 4,614,681 | 9/1986 | Hayashi et al. | 430/537 |
| 4,645,736 | 2/1987 | Anthonsen et al. | 430/538 |
| 4,861,696 | 8/1989 | Tamagawa et al. | 430/538 |

FOREIGN PATENT DOCUMENTS

| | | | |
|---|---|---|---|
| 391373 | 10/1990 | European Pat. Off. . | |
| 0085747 | 7/1981 | Japan | 430/538 |
| 2276544 | 12/1987 | Japan | 430/538 |
| 3141050 | 6/1988 | Japan | 430/538 |
| 2109704 | 8/1983 | United Kingdom | 430/538 |

*Primary Examiner*—Charles L. Bowers, Jr.
*Assistant Examiner*—Thomas R. Neville
*Attorney, Agent, or Firm*—Paul A. Leipold

[57] ABSTRACT

A silver halide color photographic reflection print element comprises a paper support impregnated or coated with a substance that lowers its oxygen transmission rate and its oxygen leak rate, at least one polyolefin-containing layer containing a total of at least 70 g/m$^2$ or a polyolefin coated on the paper support, and at least one color-forming silver halide emulsion layer, said emulsion layer or layers overlying a polyolefin-containing layer. In one embodiment, the paper support is impregnated with a substance that lowers its oxygen gas transmission rate to less than 1 cc/m$^2$/day and its oxygen leak rate to less than a 25 cc/m$^2$/day. The support has low permeability to oxygen and to water vapor. The silver halide color photographic element produces a dye image with improved resistance to fading by light, particularly under conditions of prolonged exposure to low-intensity light.

17 Claims, No Drawings

COLOR PHOTOGRAPHIC ELEMENT PROVIDING IMPROVED DYE STABILITY

CROSS-REFERENCE TO RELATED APPLICATION

Reference is made to co-pending, commonly assigned application of Skochdopole et al., U.S. Ser. No. 07/887,710, filed May 22, 1992, entitled "Color Photographic Support Which Provides Improved Dye Stability."

FIELD OF THE INVENTION

This invention relates to a silver halide photographic element and, more particularly, to a color photographic reflection print element on a paper support that provides improved dye stability on prolonged exposure to light.

BACKGROUND OF THE INVENTION

Dyes used in color photographic materials are susceptible to degradation caused by a variety of environmental factors. For example, dyes can be faded by exposure to light of various wavelengths and intensities. In some instances, the fading of dyes by light is exacerbated by the presence of oxygen. Moisture can also have a deleterious effect on the stability of photographic dyes.

A variety of methods have been proposed to restrict the access of such agents as oxygen and water to photographic images. For example, extruded polyolefin layers to increase the moisture resistance of papers used for photographic prints have been disclosed in U.S. Pat. Nos. 3,411,908; 3,630,740; 4,042,398; 4,517,285; and 4,665,014.

U.S. Pat. No. 4,645,736 discloses a waterproof paper support containing a layer of radiation hardened varnish, and with a polymeric barrier layer such as a polyolefin positioned between the varnish layer and the paper. A waterproof support in which a layer of hardenable acrylic resin is applied between the paper and a polyolefin layer is disclosed in U.S. Pat. No. 4,729,945.

U.S. Pat. No. 4,283,486 discloses an oxygen impermeable or oxygen barrier layer comprising a vinyl alcohol polymer or copolymer positioned between a paper support and a color image-forming layer. A cover sheet or protective layer to restrict oxygen located above the light-sensitive layer is disclosed in U.S. Pat. No. 4,945,025.

U.S. Pat. No. 4,614,681 discloses a polyester film support in which an oxygen barrier layer comprising a copolymer of ethylene and vinyl alcohol is coated on the back side or on both sides of the support.

A paper support of low air permeability having a coating of a hydrophobic polymer on one or both sides of the paper is disclosed in U.S. Pat. No. 4,861,696, which further suggests that a waterproofing agent can be added to the hydrophobic polymer layer.

EP Application No. 391373 discloses a photographic paper support impregnated through the surface with a low level of a synthetic polymer such as a polyacrylamide or a polyvinyl alcohol as a paper strengthening agent.

It is especially desirable to improve the stability of full color photographic prints, composed of yellow, magenta, and cyan dyes, which are produced on paper supports and are frequently displayed. The previously mentioned U.S. Pat. No. 4,283,486 reports improvement in the stability of dyes exposed to 200,000 lux high intensity xenon illumination. Although protecting the dyes of a color photographic print against the effects of high-intensity light exposure is important, it is even more important from a practical standpoint to maximize their stability to conditions of prolonged low-intensity exposure. Furthermore, it is highly desirable that any dye fade that does occur be neutral, that is, the density of each dye decreases by approximately the same amount.

BRIEF SUMMARY OF THE INVENTION

In accordance with the present invention, a silver halide color photographic reflection print element comprises: a paper support impregnated or coated with a substance that lowers its oxygen transmission rate and its oxygen leak rate; at least one color-forming silver halide emulsion layer; and one or more polyolefin layers having a total polyolefin content of at least 70 $g/m^2$, at least one of said polyolefin layers being between said emulsion layer and said support and containing at least 50 $g/m^2$ of polyolefin.

In one embodiment of the invention, the paper support is impregnated with a substance that lowers its oxygen gas transmission rate to less than 1 $cc/m^2/day$ and its oxygen leak rate to less than 25 $cc/m^2/day$. In another embodiment, the photographic element further comprises a polyolefin-containing layer that overlies the support on the side opposite to that which bears the silver halide emulsion layer.

DETAILED DESCRIPTION OF THE INVENTION

The silver halide color photographic reflection print element of the present invention produces a dye image with significantly improved resistance to fading by light. Evaluation of light stability of photographic images frequently utilizes high-intensity light sources of 50 to 200 Klux for periods of one to four weeks for reasons of convenience. However, improving the stability of photographic dyes to low-intensity illumination of 10 Klux or less is highly desirable for practical use. A photographic print obtained from an element of the invention has significantly improved stability under conditions of prolonged exposure to low-intensity light. Furthermore, a full color photographic image that is produced by an element of the present invention and contains yellow, magenta, and cyan dyes exhibits, after exposure to light, similar reductions in the densities of its yellow and magenta components in particular. The resulting neutral fade maintains the pleasing appearance of the color photograph and prolongs its useful life.

In a full color photograph, the fading of the cyan image is caused primarily by the action of light. The degradation of the yellow and magenta images, on the other hand, is the result of the combined effects of exposure to light and oxygen. The coating or impregnation of the paper support of the photographic element of the invention with a substance that greatly diminishes its oxygen permeability contributes to the improvement of yellow and magenta dye stability. The polyolefin-containing layer overlying the paper support in accordance with the invention is an effective barrier against the transmission of water vapor. It has now been unexpectedly found that the resulting deprivation of moisture in combination with the aforementioned lowering of oxygen permeability protects the dyes of a color photograph produced from the element of the invention against fading by light, particularly under the conditions of prolonged low-intensity exposure.

In accordance with the present invention, the sheet of paper support can be of any desired basis weight. It is generally preferred that the sheet have a basis weight of between about 122 g/m$^2$ (25 lb/1000 ft$^2$) and about 244 g/m$^2$ (50 lb/1000 ft$^2$). A heavier weight paper of up to 391 g/m$^2$ (80 lb/1000 ft$^2$) may be preferred for display purposes.

The paper support can be coated with a layer of a substance such as polyvinyl alcohol that reduces oxygen permeability, as disclosed in the previously mentioned U.S. Pat. No. 4,283,486, incorporated herein by reference. In a preferred embodiment of the invention, the paper support is impregnated with polyvinyl alcohol, using the procedure described in the commonly assigned, copending application of Lacz et al., Ser. No. 756,262, filed Aug. 19, 1991, entitled "Photographic Paper with Low Oxygen Permeability," incorporated herein by reference. The polyvinyl alcohol utilized can be any polyvinyl alcohol that results in a substantially impermeable paper. Polyvinyl alcohol is formed by hydrolysis of vinyl acetate. Polyvinyl alcohol prior to use is soluble in water and available in powder or pellet form. The more fully hydrolyzed polyvinyl alcohols have higher water and humidity resistance. The weight-average molecular weight may vary between above 13,000 and up to 200,000. The higher molecular weight materials have increased water resistance, adhesive strength, and viscosity. A preferred material has been found to be a medium molecular weight polyvinyl alcohol of about 99 percent hydrolysis, as this material provides reduced oxygen permeability of the paper.

The polyvinyl alcohol polymer is impregnated in any amount that provides a substantial reduction in oxygen permeability. Generally it is preferred that the pick-up range be between about 3 and about 12 weight percent of the dry paper weight for an effective barrier to oxygen infiltration. A pick-up of about 4 to about 9 weight percent is preferred for diminished oxygen permeability at low cost. Impregnation results in a paper that does not have a polyvinyl alcohol layer above the surface but has polyvinyl alcohol concentrated near both surfaces of the paper. It has been found that two applications or passes of the paper in polyvinyl alcohol solution with drying after each pass results in sufficient pick-up of polyvinyl alcohol to provide the desired decrease in oxygen permeability.

The polyolefin-containing layer is applied to the polyvinyl alcohol-impregnated paper by extrusion from a hot melt as is known from the art, for example, U.S. Pat. No. 3,411,908, incorporated herein by reference. In a preferred embodiment of the present invention, the polyolefin is polyethylene and is applied to both sides of the paper support. The total amount of polyethylene typically used in the art today to coat a photographic paper support is approximately 50 g/m$^2$. The element of the present invention, on the other hand, contains at least about 70 g/m$^2$, and preferably about 120 to about 200 g/m$^2$ of polyethylene.

In addition to the low oxygen permeability, the preferred photographic elements of the invention also have the unexpected benefit of low water vapor transmission. Although we do not wish to be bound by theoretical explanations it is believed that the combination of low permeability to oxygen and water vapor which characterizes the preferred photographic elements contributes to the unexpected resistance to light fading of the dyes. The water vapor transmission of photographic elements can be measured by the procedure of ASTM F372. The photographic elements of the invention preferably have a water vapor transmission rate at 38° C. (100° F.) and 100% Relative Humidity (RH) no greater than 0.02 g/m$^2$/day and, most preferably, no greater than 0.01 g/m$^2$/day.

The polyolefin-coated paper support of the present invention can be utilized in the formation of a photographic element which, after exposing and processing, generates a colored image that is surprisingly stable to light. Furthermore, the image exhibits more nearly neutral fade to light; the image dyes fade at approximately the same rate, thus prolonging the useful lifetime of the print. In a typical color print, the light stabilities of the yellow and magenta image dyes are usually inferior to the light stability of the cyan image dye, leading to an objectionable non-neutral fade of the color print. For color prints on supports of the present invention, however, the light stabilities of the yellow and magenta image dyes are improved substantially, while the light stability of the cyan image dye remains largely unaffected, leading to greater image stability and neutral color fade. The yellow and magenta image dyes which benefit from the supports of the invention are formed by the reaction of oxidized color developing agents with 2- and 4-equivalent image couplers such as open-chain ketomethylene compounds, pyrazolones, pyrazolotriazoles, and pyrazolobenzimidazoles. Typically, such image couplers are ballasted for incorporation in high boiling coupler solvents.

Couplers which form magenta dyes upon reaction with oxidized color developing agents are described in such representative patents and publications as: U.S. Pat. Nos. 2,600,788; 2,369,489; 2,343,703; 2,311,082; 2,908,573; 3,152,896; 3,519,429; 3,062,653; and T. H. James, editor, *The Theory of the Photographic Process*, 4th Edition, MacMillan, New York, 1977, pp 356–358, all incorporated herein by reference.

Couplers which form yellow dyes upon reaction with oxidized color developing agents are described in such representative patents and publications as: U.S. Pat. Nos. 2,298,443; 2,875,057; 2,407,210; 3,048,194; 3,265,506; 3,447,928; 5,021,333, and *The Theory of the Photographic Process*, pp 354–356, all incorporated herein by reference.

In addition, other image couplers which can be used are described in the patents listed in *Research Disclosure*, December 1989, Item No. 308119, Section VII D, the disclosure of which is incorporated herein by reference.

Another key element to enhancing the useful lifetime of a color print is the reduction or elimination of the yellow stain which can form on prolonged exposure to light. This can be accomplished by coating an ultraviolet light (UV) absorber in the photographic element. Typically the UV absorbers are substituted phenylbenzotriazoles, which are described in such representative patents as U.S. Pat. Nos. 4,383,863; 4,447,511; 4,790,959; 4,752,298; 4,853,471; 4,973,701, which are incorporated herein by reference. Ultraviolet light absorbers which are liquids are preferred in order to minimize crystallization and surface blooming problems observed with solid absorbers.

Various layers to convert the paper support into a light reflecting print material, such as silver halide emulsion layers, subbing layers, interlayers, and overcoat layers are provided in the photographic element of the invention. The silver halide emulsion employed in the elements of this invention can be either negative-working or positive-working. Suitable emulsions and their preparation are described in sections I and II of *Research Disclosure*, December 1989, Item No. 308119, sections I and II, the disclosure of which is incorporated herein by reference. The silver halide emulsions employed in the present invention preferably comprise silver chloride grains which are at least 80 mole percent silver chloride and the remainder silver bromide.

The following examples further illustrate the invention. Given below are the structures of the cyan magenta, and yellow couplers (couplers C, M, Y, respectively), ultraviolet light (UV) absorbers U, V, and W, and stabilizer S used in the examples.

Coupler C

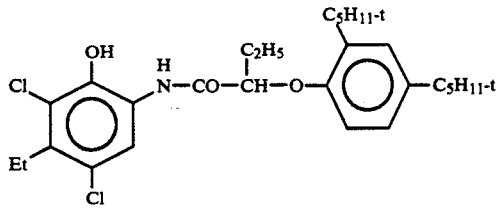

Coupler M

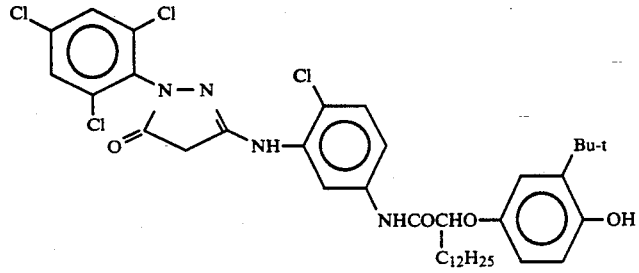

Coupler Y

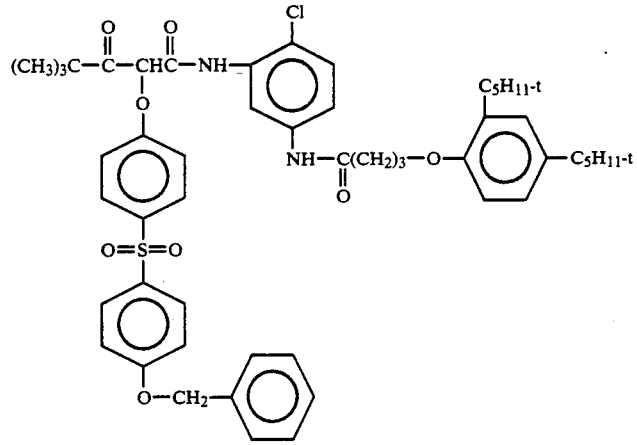

UV Absorber W

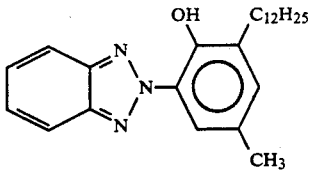

UV Absorber U

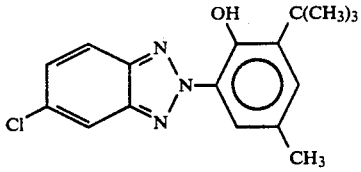

UV Absorber V

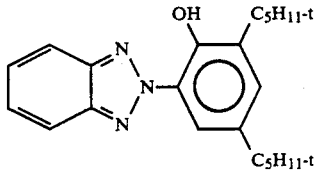

-continued

Stabilizer S

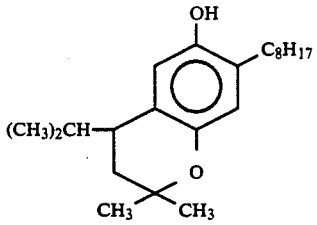

Table 1 shows the component layers of the color photographic materials coated on the paper supports described in the examples.

TABLE 1

| Layer No. | Layer | Material | Coverage (mg/m2) |
|---|---|---|---|
| 7 | Protective | Gelatin | 1345 |
| 6 | UV absorber** | Gelatin | |
| | | UV Absorber | |
| 5 | Red-sensitive | Gelatin | 1076 |
| | | Red-sensitive silver halide* | 253 |
| | | Coupler C | 423 |
| | | Dibutyl phthalate | 212 |
| 4 | UV absorber** | Gelatin | |
| | | UV absorber | |
| 3 | Green-sensitive | Gelatin | 1237 |
| | | Green-sensitive silver halide* | 283 |
| | | Coupler M | 423 |
| | | Stabilizer S | 92 |
| | | Dibutyl phthalate | 211 |
| 2 | Interlayer | Gelatin | 753 |
| 1 | Blue-sensitive | Gelatin | 1506 |
| | | Blue-sensitive silver halide* | 292 |
| | | Coupler Y | 1076 |
| | | Dibutyl phthalate | 269 |

*Silver halide emulsions are $AgBr_1Cl_{99}$;
**UV absorber layers 4 and 6 in Elements I and II each contain 860 mg/m$^2$ of gelatin and 590 mg/m$^2$ of UV absorber W. UV absorber layers 4 and 6 in Elements III, IV, and V each contain 700 mg/m$^2$ of gelatin, 57 mg/m$^2$ of UV absorber U, and 323 mg/m$^2$ of UV absorber V.

EXAMPLE 1

Preparation of Polyvinyl Alcohol-Impregnated Paper Supports, and Preparation and Testing of Corresponding Photographic Coatings A paper with a basis weight of 244 g/m$^2$ (50 lb/1000 ft$^2$) was impregnated with 8 weight percent polyvinyl alcohol (based on the weight of the dry starting paper), following the two-pass procedure of the previously mentioned co-pending application, Ser. No. 756,262, "Photographic Paper with Low Oxygen Permeability." The polyvinyl alcohol, which was obtained from Marubeni Co., was 99%+hydrolyzed; a 4% aqueous solution of this material at 20° C. has a viscosity of 27–32 centipoises. The polyvinyl alcohol-impregnated paper was extrusion coated with 25 g/m$^2$ of polyethylene on both the front and rear sides. The polyethylene layer on the front side also contained 12.5 weight percent anatase $TiO_2$, 3.0 weight percent ZnO, 0.5 weight percent calcium stearate, and small amounts of antioxidant, colorants, and optical brightener. The material so obtained was designated paper support (1).

On the front side of paper support (1) was coated a conventional color photographic material having the component layers shown in Table 1 above. The photographic element prepared as described above from paper support (1) was designated Element I.

The same polyvinyl alcohol-impregnated paper used for the preparation of paper support (1) was extrusion coated with polyethylene layers on both the front and rear sides, but the laydown was increased to 70 g/m$^2$ on each side. The material so obtained was designated paper support (2).

On the front side of paper support (2) was coated the same color photographic material used in the preparation of Element I. The photographic element so prepared from paper support (2) was designated Element II.

The same paper used for paper support (1) was extrusion coated with 25 g/m$^2$ of polyethylene on both the front and rear sides, using the formulations described above for support (1), but the step of prior impregnation with polyvinyl alcohol was omitted. The material so obtained was designated paper support (3).

On the front side of paper support (3) was coated a color photographic material as shown in Table 1 above. The photographic element so prepared from paper support (3) was designated Element III.

Elements I, II, and III were exposed through an optical step wedge separately to red, green, and blue light to give separate cyan, magenta, and yellow dye records before standard Kodak Ektacolor RA-4 processing.

Dye stability of each of the three separation dye records was determined by exposure to 5.4 Klux daylight for 168 days and measurement of the loss of density from an initial density of 1.0. The results are given in Table 2 below:

TABLE 2

| Element | Yellow Fade | Magenta Fade | Cyan Fade |
|---|---|---|---|
| I | −0.38 | −0.49 | −0.16 |
| II | −0.29 | −0.34 | −0.16 |
| III | −0.41 | −0.60 | −0.16 |

The data of Table 2 show the poor dye stability, particularly in the magenta dye record, measured for Element III, which was prepared from a paper support containing no polyvinyl alcohol and a total amount of 50 g/m$^2$ of coated polyethylene. Slight reductions in magenta and yellow dye fade were observed with Element I, whose paper support contained the same amount of polethylene as that of Element III but was impregnated with 8 weight percent of polyvinyl alcohol. Element II, on the other hand, showed greatly improved yellow and magenta dye stability and a more nearly neutral fade than did Elements III and I. These results illustrate the benefit of improved dye stability under conditions of prolonged low-intensity light exposure obtained, in accordance with the present invention, from Element II, whose paper support was impregnated with polyvinyl alcohol and coated with a total amount of 140 g/m$^2$ of polyethylene.

EXAMPLE 2

Measurement of Oxygen and Water Vapor Permeability of Polyvinyl Alcohol-Impregnated Paper Supports The oxygen permeability properties of supports (1), (2), and (3) were determined by measurement of two values: oxygen leak rate and oxygen gas transmission rate. The oxygen gas transmission rate measurements were made according to ASTM D3985-81 on 50 $cm^2$ extrusion coated samples, with the side to be emulsion coated facing the chamber with the oxygen sensor, at 38° C. (100° F.) and approximately 65% RH, using pure oxygen. The oxygen leak rate was measured, using the same apparatus and test conditions, as follows: Nitrogen gas was introduced as the carrier gas in both the upper and lower chambers. After a suitable amount of time (30–180 minutes) the oxygen sensor was inserted into the lower chamber exhaust stream. Once equilibrium was established, the rate of oxygen reaching the sensor was recorded as the oxygen leak rate. The oxygen leak rate thus represents the rate that oxygen is reaching the sensor from 1) outgassing of the sample, 2) leaks in the system, and 3) leaks through the edge of the paper and diffusion through the polyethylene layer. Following the oxygen leak rate measurement, pure oxygen was introduced into the upper chamber (non-sensor side), and oxygen gas transmission rate measurements were carried out as described above.

The water vapor transmission rates of paper supports (1), (2), and (3) were measured according to the procedure of ASTM F372 at 38° C. (100° F.), 100% RH, using 50 $cm^2$ samples.

The results of the oxygen permeability and water vapor transmission rate measurements for paper supports (1), (2), and (3) are given in Table 3 below:

TABLE 3

| Paper Support | Oxygen Gas Transmission Rate cc/$m^2$/day | Oxygen Leak Rate cc/$m^2$/day | Water Vapor Transmission Rate g/$m^2$/day | Water Vapor Transmission Rate g/100 $in^2$/day) |
|---|---|---|---|---|
| (1) | 0.12 | 2.9 | 0.030 | (0.34) |
| (2) | 0.10 | 1.4 | 0.010 | (0.12) |
| (3) | 160 | 400 | 0.035 | (0.40) |

The oxygen gas transmission rate data in Table 2 illustrate the very large reduction in oxygen permeability which resulted from impregnation with polyvinyl alcohol of the paper used for paper supports (1) and (2). A large decrease in oxygen leak rate was also observed for these two materials compared with paper support (3), which did not contain polyvinyl alcohol. Comparing the data from supports (1) and (2), the latter, which contained the larger amount of coated polyethylene, was slightly less oxygen-permeable.

Comparing measurements for paper supports (1) and (3) shows that impregnation of the paper with polyvinyl alcohol slightly lowered the water vapor transmission rate. However a considerably greater decrease in water vapor transmission rate was found for paper support (2), which had 70 g/$m^2$ of polyethylene coated on each side of the paper.

EXAMPLE 3

Preparation of Polyvinyl Alcohol-Coated Paper Supports, and Preparation and Testing of Corresponding Photographic Coatings A paper with a basis weight of 191 g/$m^2$ (39 lb/1000 $ft^2$) was coated on the front side with a 3.5 g/$m^2$ layer of polyvinyl alcohol (99+% hydrolyzed, from Marubeni Co.), which was then extrusion coated with 25 g/$m^2$ of polyethylene on both the front and rear sides. The material so obtained was designated paper support (4).

Similarly, a paper coated on the front side with a 3.5 g/$m^2$ layer of polyvinyl alcohol was extrusion coated on the front side with 100 g/$m^2$ and on the rear side with 25 g/$m^2$ of polyethylene. The material so obtained was designated paper support (5).

On the front sides of paper supports (4) and (5) were coated a conventional color photographic material as shown in Table 1 above. The photographic elements so prepared from supports (4) and (5) were designated as Elements IV and V, respectively.

Elements IV and V were exposed and processed as described in Example 1. Element III, which has the same components and concentrations as Element IV except that it lacks a layer of coated polyvinyl alcohol, was included as a control.

Dye stability of each of the three separation dye records was determined by exposure to 5.4 Klux fluorescent light for 252 days and measurement of the loss of density from an initial density of 1.0. The results are given in Table 4 below:

TABLE 4

| Element | Yellow Fade | Magenta Fade |
|---|---|---|
| III | −0.27 | −0.26 |
| IV | −0.25 | −0.23 |
| V | −0.20 | −0.18 |

Comparison of the dye fade data for Elements III and IV shows the modest improvement in light stability that resulted from inclusion of a polyvinyl alcohol oxygen barrier layer in the latter coating. Both Elements III and IV contained a total amount of 50 g/$m^2$ of polyethylene, and amount typically used in present day color photographic reflection print products.

The results from Element V demonstrate the marked improvement in yellow and magenta dye stability under conditions of prolonged low-intensity light exposure that unexpectedly resulted when the amount of polyethylene applied to the polyvinyl alcohol-coated paper was increased to a total amount of 125 g/$m^2$. Thus, increased amounts of coated polyolefin are beneficial for improving image dye stability under low intensity light fading conditions not only of polyvinyl alcohol-impregnated paper supports but also on other reflective supports that contain materials with good oxygen barrier properties, for example, polyethylene terephthalate, polyamides, halogenated vinyl polymers, and the homopolymers or copolymers of vinyl alcohol disclosed in the previously mentioned U.S. Pat. No. 4,283,486.

The invention has been described in detail with particular reference to preferred embodiments thereof, but it will be understood that variations and modifications can be effected within the spirit and scope of the invention.

What is claimed is:

1. A silver halide color photographic print element comprising:

a paper support impregnated or coated with a substance that lowers its oxygen transmission rate and its oxygen leak rate;

at least one color-forming silver halide emulsion layer; and one or more polyolefin layers having a total polyolefin content of at least 70 g/m$^2$, at least one of said polyolefin layers being between said emulsion layer and said support and containing at least 50 g/m$^2$ of polyolefin.

2. A photographic element of claim 1 wherein said paper support is impregnated with a substance that lowers its oxygen gas transmission rate to less than 1 cc/m$^2$/day and its oxygen leak rate to less than 25 cc/m$^2$/day.

3. A photographic element of claim 1 further comprising a polyolefin-containing layer on said support on the side opposite to that which bears said emulsion layer.

4. A photographic element of claim 3 wherein said polyolefin in said polyolefin-containing layers is polyethylene.

5. A photographic element of claim 4 that contains from about 100 to about 200 g/m$^2$ of polyethylene.

6. A photographic element of claim 4 wherein each of said polyolefin-containing layers contains at least about 70 g/m$^2$ of polyethylene.

7. A photographic element of claim 1 wherein said oxygen gas transmission rate-reducing and oxygen leak rate-reducing substance is polyvinyl alcohol.

8. A photographic element of claim 7 wherein said paper support contains from about 3 to about 12 weight percent of polyvinyl alcohol.

9. A photographic element of claim 8 wherein said support contains from about 4 to about 9 weight percent polyvinyl alcohol.

10. A photographic element of claim 1 wherein said emulsion layer contains at least one yellow or magenta dye-forming coupler.

11. A photographic element of claim 10 wherein said yellow dye-forming coupler is an open-chain ketomethylene compound.

12. A photographic element of claim 10 wherein said magenta dye-forming coupler is a pyrazolone compound.

13. A photographic element of claim 1 comprising an emulsion layer containing a yellow coupler, an emulsion layer containing a magenta coupler, and an emulsion layer containing a cyan coupler.

14. A photographic element of claim 1 further comprising a layer that contains an ultraviolet absorber overlying said emulsion layer.

15. A photographic element of claim 14 wherein said ultraviolet absorber is a substituted 2-phenylbenzotriazole compound.

16. A photographic element of claim 1 wherein the water vapor transmission rate is no greater than 0.02 g/m$^2$/day.

17. A photographic element of claim 16 wherein the water vapor transmission rate is no greater than 0.01 g/m$^2$/day.

* * * * *